US011302503B2

(12) United States Patent
Pan et al.

(10) Patent No.: US 11,302,503 B2
(45) Date of Patent: Apr. 12, 2022

(54) CLAPPER-TYPE ELECTROMAGNETIC RELEASE FOR MINIATURE CIRCUIT BREAKER

(71) Applicant: Shanghai Liangxin Electrical Co., Ltd, Shanghai (CN)

(72) Inventors: Wanjun Pan, Shanghai (CN); Yanqun Yang, Shanghai (CN)

(73) Assignee: Shanghai Liangxin Electrical Co., LTD, Shanghai (CN)

( * ) Notice: Subject to any disclaimer, the term of this patent is extended or adjusted under 35 U.S.C. 154(b) by 0 days.

(21) Appl. No.: 16/758,557

(22) PCT Filed: Oct. 17, 2018

(86) PCT No.: PCT/CN2018/110716
§ 371 (c)(1),
(2) Date: Apr. 23, 2020

(87) PCT Pub. No.: WO2019/080762
PCT Pub. Date: May 2, 2019

(65) Prior Publication Data

US 2020/0350135 A1 Nov. 5, 2020

(30) Foreign Application Priority Data

Oct. 26, 2017 (CN) ..... 201711014353.7

(51) Int. Cl.
*H01H 71/24* (2006.01)
*H01H 50/36* (2006.01)
(Continued)

(52) U.S. Cl.
CPC ..... *H01H 71/24* (2013.01); *H01H 50/02* (2013.01); *H01H 50/18* (2013.01); *H01H 50/36* (2013.01)

(58) Field of Classification Search
CPC ..... H01H 71/24; H01H 50/36
(Continued)

(56) References Cited

U.S. PATENT DOCUMENTS 6,407,653 B1 * 6/2002 Zindler ..... H01H 71/7463 335/172
6,633,211 B1 * 10/2003 Zindler ..... H01H 71/2472 335/35
(Continued)

FOREIGN PATENT DOCUMENTS

CH 225441 1/1943
CN 201294206 8/2009
(Continued)

OTHER PUBLICATIONS

International Search Report and Written Opinion from PCT/CN2018/110716 dated Dec. 26, 2018.
(Continued)

*Primary Examiner* — Alexander Talpalatski
(74) *Attorney, Agent, or Firm* — Hogan Lovells US LLP

(57) ABSTRACT

A clapper-type electromagnetic release for a miniature circuit breaker is characterized by including an armature, a magnet yoke, a coil, an iron core, a shaft, and an armature torsion spring. The iron core is mounted on the magnet yoke. The coil is sleeved on the iron core. The armature is mounted on the shaft and can rotate around the shaft. The armature torsion spring is mounted on the shaft. The armature torsion spring presses against the armature, so that the armature can be reset. In the clapper-type electromagnetic release for a miniature circuit breaker, by the rotation of the armature, the armature is not closed in absorption and the circuit breaker mechanism is not tripped within a specified current range; and when the specified current range is exceeded, the
(Continued)

armature is closed in absorption and the armature claps a lock, so that the circuit breaker mechanism is tripped.

6 Claims, 5 Drawing Sheets

(51) Int. Cl.
*H01H 50/02* (2006.01)
*H01H 50/18* (2006.01)

(58) Field of Classification Search
USPC ..... 335/166
See application file for complete search history.

(56) References Cited

U.S. PATENT DOCUMENTS

| | | | | |
|---|---|---|---|---|
| 6,803,850 | B2 * | 10/2004 | Richter | H01H 71/164 335/35 |
| 7,205,871 | B1 * | 4/2007 | Zindler | H01H 71/505 335/167 |
| 7,800,466 | B2 * | 9/2010 | Puhalla | H01H 71/7463 335/23 |
| 7,800,478 | B2 * | 9/2010 | Puhalla | H01H 71/40 337/107 |
| 8,542,084 | B1 * | 9/2013 | Newase | H01H 71/2472 335/174 |
| 2002/0171519 | A1 * | 11/2002 | Lanning | H01H 71/2472 335/172 |

FOREIGN PATENT DOCUMENTS

| | | |
|---|---|---|
| CN | 202616161 | 12/2012 |
| CN | 202678240 | 1/2013 |
| CN | 104733263 | 6/2015 |
| CN | 107887237 | 4/2018 |
| JP | 38-20350 | 10/1963 |
| JP | 63-207020 | 2/1987 |
| JP | 3-116546 | 12/1991 |
| JP | 2002-329450 | 11/2002 |
| JP | 2021-500733 | 1/2021 |

OTHER PUBLICATIONS

English Translation of Chinese Abstracts.
AU Office Action from application 2018357312 dated Nov. 6, 2020.
CA Office Action from application 3,079,990 dated Jun. 8, 2021.
EP Office action from application 18870083.5 dated Dec. 8, 2020.
IN Office Action from application 202027021311 dated Dec. 10, 2020.
JP Office Action from application 2020-543676 (unknown date).
Decision to Grant of JP 2020-543676 dated Aug. 29, 2021 with English Translation.
KR Office Action from application 10-2020-7014121 dated Oct. 15, 2021 with English Translation.

* cited by examiner

CLAPPER-TYPE ELECTROMAGNETIC RELEASE FOR MINIATURE CIRCUIT BREAKER

TECHNICAL FIELD

The present disclosure pertains to the technical field of internal structures of circuit breakers, in particular to a clapper-type electromagnetic release for a miniature circuit breaker.

BACKGROUND ART

Circuit breakers are classified into high-voltage circuit breakers and low-voltage circuit breakers according to their use ranges. The low-voltage circuit breaker, also called as automatic switch ("air switch" as commonly called also refers to a low-voltage circuit breaker), is an electric appliance which not only has the function of a manual switch, but also can automatically provide protections against no-voltage, undervoltage, overload, and short-circuit. It can be used for distributing electric energy, starting an asynchronous motor infrequently, protecting power supply circuits and motors, etc. in real time, and when serious faults such as overload, short-circuit or undervoltage occur, it can automatically cut off the circuits or motors, with the function of the circuit breaker being equivalent to combination of a fuse type switch and an overvoltage relay, undervoltage relay or thermal relay, etc., and after the fault current is cut off, there is generally no need to change parts, so that it has been widely used.

A short-circuit protection mechanism, also called an electromagnetic release, is usually provided inside the circuit breaker, and when a current passing through the circuit breaker increases to a certain value, the electromagnetic release causes the circuit breaker to be rapidly tripped, so as to achieve the function of circuit protection. In the prior art, a linear-motion electromagnetic release is usually adopted, when short circuit occurs in a circuit, movable and static iron cores are pulled in instantaneously, the movable iron core pushes a mandril (ram) to move forwards, and the mandril pushes a lock to release, so that the system is tripped. However, such conventional electromagnetic release needs to occupy a relatively large volume of space, and drives the mandril to move using the movement of the movable iron core, therefore, the occurrence of locking of motion transmission is easily caused due to existence of fit clearance, so that the working stability of the electromagnetic release is influenced.

SUMMARY

An object of the present disclosure is to provide a clapper-type electromagnetic release for a miniature circuit breaker, directed to the technical defect that locking of movement transmission easily occurs in the prior direct-acting electromagnetic release in which a mandril is drive to move by movement of a movable iron core. By means of rotation of an armature, it is realized that the armature is not pulled in and the circuit breaker mechanism is not tripped within a specified current range, and when the specified current range is exceeded, the armature is pulled in and the armature flaps a lock, so that the circuit breaker mechanism is tripped, thereby improving the safety performance of the circuit breaker.

TECHNICAL SOLUTION

In order to achieve the above technical object, the clapper-type electromagnetic release for a miniature circuit breaker designed in the present disclosure is featured in including an armature, a magnet yoke, a coil, an iron core, a shaft and an armature torsion spring, wherein the iron core is mounted on the magnet yoke, the coil is sleeved on the iron core, the armature is mounted on the shaft and is rotatable around the shaft, the armature torsion spring is mounted on the shaft, and the armature torsion spring presses against the armature, so that the armature can be reset.

Further, the magnet yoke includes a pair of magnet yoke plates which are disposed face to face, fixation plates respectively protrude from inner side surfaces of the magnet yoke plates, the fixation plates are provided therein with fixing holes, and the fixing holes are provided on a fixing post on a housing to fix the magnet yoke.

Further, two ends of the iron core are respectively mounted in installation holes in the magnet yoke plates, wherein the two ends of the iron core are steps, and step surfaces of the steps abut against the respective magnet yoke plates.

Further, an inner side surface of the armature extends out of the mounting plates, shaft installation holes are respective provided in the mounting plates, wherein two ends of the shaft are respectively mounted in the shaft installation holes, the armature torsion spring is mounted on the shaft and located between the mounting plates, and the armature torsion spring has one end lapped on the housing, and the other end lapped on a lower surface of the armature.

Further, the armature is a flat plate, wherein upper surfaces of the magnet yoke plates are flat surfaces corresponding to the flat plate, and a front end of the armature is provided with a tripping boss.

Further, the shaft is fixedly mounted on a housing.

Further, the iron core is in a rectangular shape, wherein two ends of the iron core are mounted in corresponding rectangular holes in the magnet yoke plates, and the two ends of the iron core pass through the rectangular holes and then are fixedly mounted on the housing.

Further, the iron core forms an integral U-shaped structure with the magnet yoke plates, and the coil is mounted on a bottom plate of the U-shaped structure.

Further, the iron core forms an integral L-shaped magnet yoke iron core with one of the magnet yoke plates, the armature forms an integral L shape with the other one of the magnet yoke plates, and the coil is mounted on a bottom plate of the L-shaped magnet yoke iron core.

Beneficial Effects

In the clapper-type electromagnetic release for a miniature circuit breaker provided in the present disclosure, by using rotation of the armature, it is realized that the armature is not pulled in and the circuit breaker mechanism is not tripped within a specified current range, and when the specified current range is exceeded, the armature is pulled in and the armature flaps a lock, so that the circuit breaker mechanism is tripped, thereby improving the safety performance of the circuit breaker.

DETAILED DESCRIPTION OF EMBODIMENTS

The present disclosure is further described below in connection with accompanying drawings and embodiments.

Embodiment 1

Figure 1:
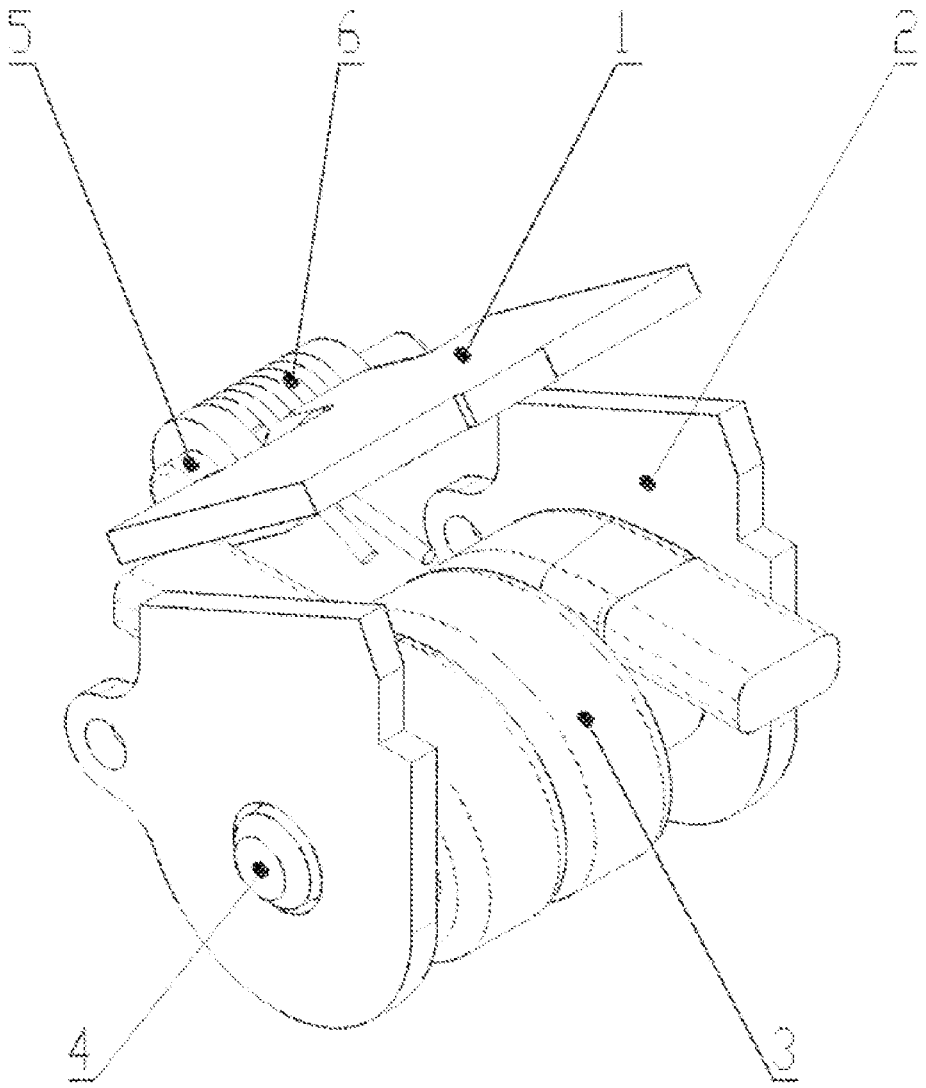
FIG. 1 is a structural schematic view of Embodiment 1 of the present disclosure.
Figure 2:
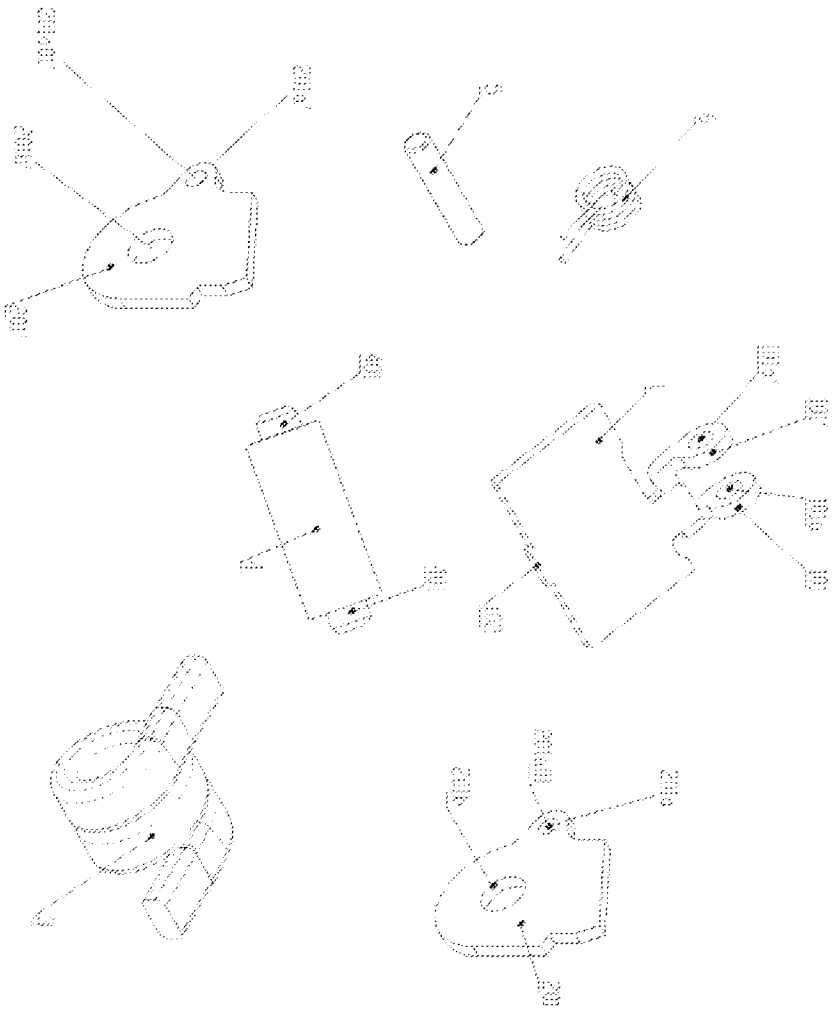
FIG. 2 is an exploded view of Embodiment 1 of the present disclosure.

As shown in FIG. 1 and FIG. 2, a clapper-type electromagnetic release for a miniature circuit breaker includes an armature 1, a magnet yoke 2, a coil 3, an iron core 4, a shaft 5 and an armature torsion spring 6, wherein the iron core 4 is mounted on the magnet yoke 2, the coil 3 is sleeved on the iron core 4, the armature 1 is mounted on the shaft 5 and is rotatable around the shaft 5, the armature torsion spring 6 is mounted on the shaft 5, and the armature torsion spring 6 presses against the armature 1, so that the armature can be reset.

Specifically, in the present embodiment, the magnet yoke 2 includes a pair of magnet yoke plates 201, 201' which are disposed face to face, fixation plates 201*a*, 201*a*' respectively protrude from inner side surfaces of the magnet yoke plates 201, 201', the fixation plates 201*a*, 201*a*' are respectively provided therein with fixing holes 201*a*01, 201*a*01', and the fixing holes 201*a*01, 201*a*01' are provided on a fixing post 701 on a housing 7 to fix the magnet yoke 2. Two ends of the iron core 4 are respectively mounted in installation holes 201*b*, 201*b*' in the magnet yoke plates 201, 201', the two ends of the iron core 4 are steps 401, wherein step surfaces of the steps 401 abut against the respective magnet yoke plates 201, 201'. An inner side surface of the armature 1 extends out of the mounting plates 101, 101', shaft installation holes 101*a*, 101*a*' are respectively provided in the mounting plates 101, 101', wherein two ends of the shaft 5 are respectively mounted in the shaft installation holes 101*a*, 101*a*', and two ends of the shaft 5 pass through the shaft installation holes 101*a*, 101*a*' and then are fixedly mounted on the housing 7. The armature torsion spring 6 is mounted on the shaft 5 and located between the mounting plates 101, 101', and the armature torsion spring 6 has one end lapped on the housing 7, and the other end lapped on a lower surface of the armature 1.

The armature 1 is a flat plate, wherein upper surfaces of the magnet yoke plates 201, 201' are flat surfaces corresponding to the flat plate, and a front end of the armature 1 is provided with a tripping boss 102.

Figure 3:
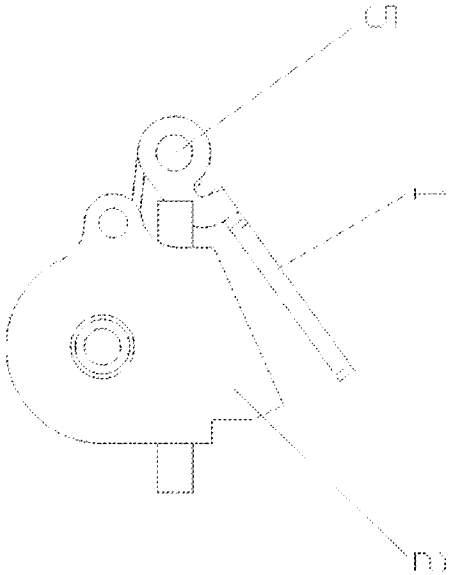
FIG. 3 is a diagram showing a state in which Embodiment 1 of the present disclosure is not clapped.
Figure 4:
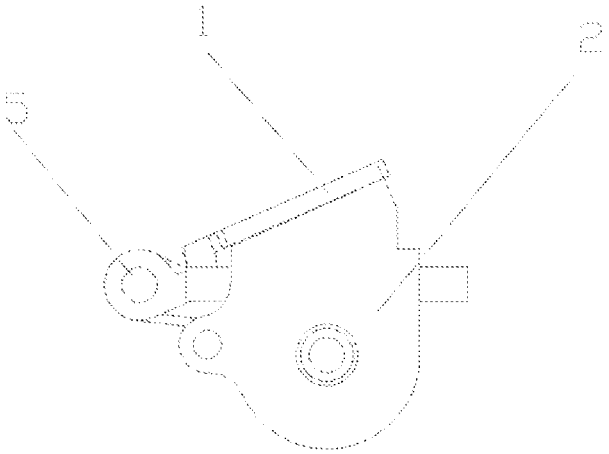
FIG. 4 is a diagram showing a state in which Embodiment 1 of the present disclosure is clapped.
Figure 5:
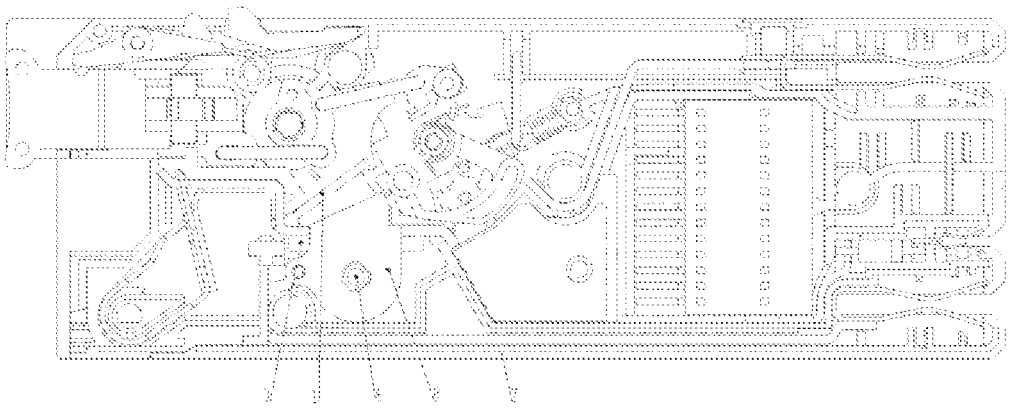
FIG. 5 is a diagram showing a state in which Embodiment 1 of the present disclosure is not clapped in a circuit breaker.
Figure 6:
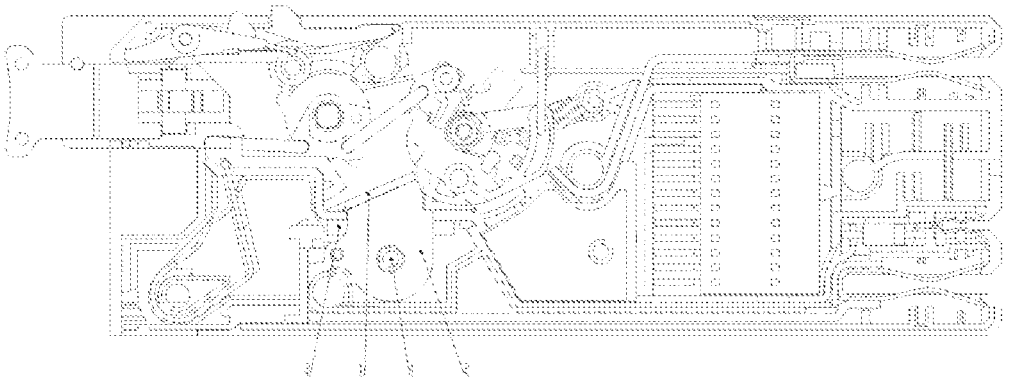
FIG. 6 is a diagram showing a state in which Embodiment 1 of the present disclosure is clapped in the circuit breaker.

As shown in FIG. 3 and FIG. 5, when a relatively small current passes through the coil 3 of the electromagnetic release, an attraction force between the armature 1 and the magnet yoke 2 of the electromagnetic release is smaller than a counter force from the armature torsion spring 6, then the armature 1 is kept in a static state under the action of the armature torsion spring 6, and the armature 1 does not flap the lock, so that the circuit breaker is not tripped;

As shown in FIG. 4 and FIG. 6, when the circuit breaker is closed, and when the current passing through the coil 3 is greater than a certain value, the attraction force between the armature 1 and the magnet yoke 2 of the electromagnetic release is greater than the counter force from the armature torsion spring 6, then the armature 1 overcomes the counter force from the armature torsion spring 6 under the action of the attraction force to rotate around the shaft 5 towards the direction of the magnet yoke 2, and flaps the lock so that the circuit breaker is tripped.

After the circuit breaker is open, the armature 1 will restore to an unclapped state under the action of the armature torsion spring 6.

Embodiment 2

Figure 7:
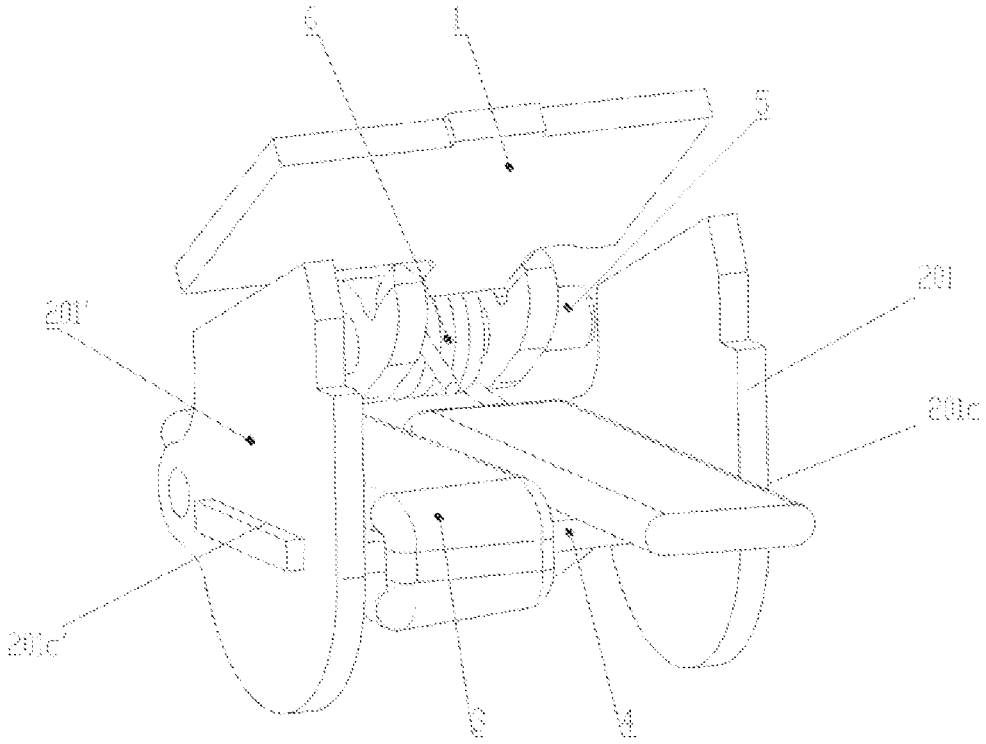
FIG. 7 is a structural schematic view of Embodiment 2 of the present disclosure.
Figure 8:
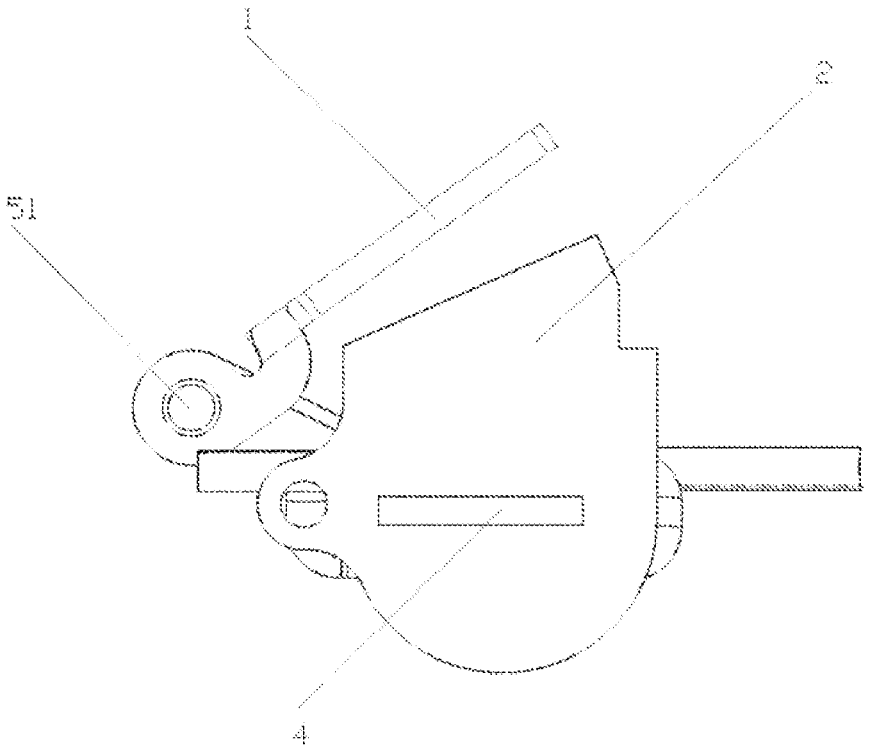
FIG. 8 is a schematic front view of Embodiment 2 of the present disclosure.

As shown in FIG. 7 and FIG. 8, the iron core 4 is in a rectangular shape, wherein two ends of the iron core 4 are mounted in corresponding rectangular holes 201*c*, 201*c*' in the magnet yoke plates 201, 201', and the two ends of the iron core 4 pass through the rectangular holes 201*c*, 201*c*' and then are fixedly mounted on the housing 7. A working process of the present embodiment is the same as Embodiment 1 and will not be further illustrated herein.

Embodiment 3

Figure 9:
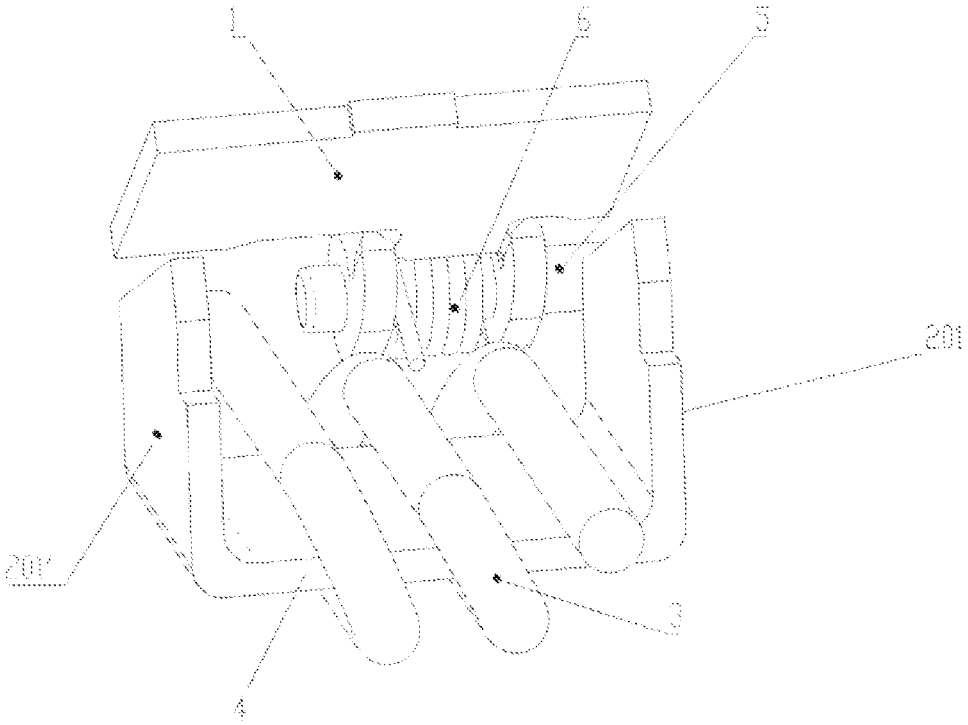
FIG. 9 is a structural schematic view of Embodiment 3 of the present disclosure.

As shown in FIG. 9, the iron core 4 can also form an integral U-shaped structure with the magnet yoke plates 201, 201', and the coil 3 is mounted on a bottom plate of the U-shaped structure.

Embodiment 4

Figure 10:
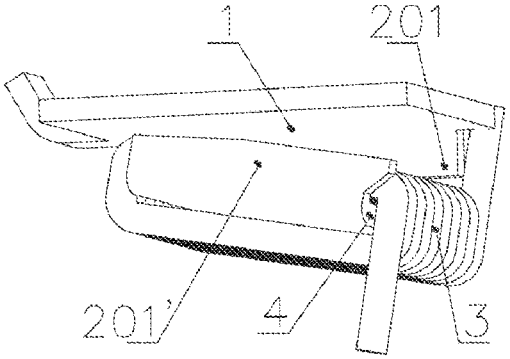
FIG. 10 is a structural schematic view of Embodiment 4 of the present disclosure.

As shown in FIG. 10, the iron core 4 can also form an integral L-shaped magnet yoke iron core with one of the magnet yoke plates 201, 201', the armature 1 forms an integral L shape with the other one of the magnet yoke plates 201, 201', and the coil 3 is mounted on a bottom plate of the L-shaped magnet yoke iron core.

The structures, ratios, sizes, quantities and so on depicted in the accompanying drawings of the present embodiment are only used to match the contents disclosed in the description, to be understood and read by those familiar with the art, rather than being used for limiting conditions under which the present disclosure can be implemented, therefore, they do not have technical significance, and any structural modifications, changes of ratio relations, or adjustments of sizes, without affecting the efficacy and the purpose that can be produced and achieved by the present disclosure, shall still fall within the scope that can be covered by the technical contents disclosed in the present disclosure. Meanwhile, wordings such as "upper", "lower", "left", "right", "middle", "clockwise", and "counterclockwise" referred to in the present description are also used for clarity of description only, rather than being used to limit the implementable scope of the present disclosure, and changes or adjustment of the relative relationship therebetween, without substantial technical changes, also should be considered as the implementable scope of the present disclosure.

What is claimed is:

1. A clapper-type electromagnetic release for a miniature circuit breaker, comprising an armature, a magnet yoke, a coil, an iron core, a shaft and an armature torsion spring, wherein the iron core is mounted on the magnet yoke, the coil is sleeved on the iron core, the armature is mounted on the shaft and is rotatable around the shaft, the armature torsion spring is mounted on the shaft, and the armature torsion spring presses against the armature, so as to make the armature reset, wherein the magnet yoke comprises a pair of magnet yoke plates which are disposed face to face, fixation plates protrude from inner side surfaces of the respective magnet yoke plates, the fixation plates are respectively provided therein with fixing holes, and the fixing holes are mounted on a fixing post on a housing to fix the magnet yoke.

2. The clapper-type electromagnetic release for a miniature circuit breaker according to claim 1, wherein two ends of the iron core are respectively mounted in installation holes in the magnet yoke plates, the two ends of the iron core are steps, and step surfaces of the steps abut against the respective magnet yoke plates.

3. The clapper-type electromagnetic release for a miniature circuit breaker according to claim 1, wherein an inner side surface of the armature extends out of the mounting plates, shaft installation holes are respectively provided in the mounting plates, two ends of the shaft are respectively mounted in the shaft installation holes, the armature torsion spring is mounted on the shaft and located between the mounting plates, and the armature torsion spring has one end lapped on the housing of the circuit breaker, and the other end lapped on a lower surface of the armature.

4. The clapper-type electromagnetic release for a miniature circuit breaker according to claim 1, wherein the armature is a flat plate, upper surfaces of the magnet yoke plates are flat surfaces corresponding to the flat plate, and a front end of the armature is provided with a tripping boss.

5. The clapper-type electromagnetic release for a miniature circuit breaker according to claim 1, wherein the shaft is fixedly mounted on the housing of the circuit breaker.

6. The clapper-type electromagnetic release for a miniature circuit breaker according to claim 3, wherein the shaft is fixedly mounted on the housing of the circuit breaker.

* * * * *